US009694504B2

(12) United States Patent
Gratsias et al.

(10) Patent No.: US 9,694,504 B2
(45) Date of Patent: Jul. 4, 2017

(54) RAZOR HANDLE COMPRISING AN ELEMENT WITHIN A HOLE AND RAZOR COMPRISING SUCH A RAZOR HANDLE

(71) Applicant: BIC-VIOLEX SA, Anixi, Attiki (GR)

(72) Inventors: Spiros Gratsias, Kipseli-Athens (GR); Ioannis Marios Psimadas, Vrilissia-Athens (GR); Georgios Georgakis, Melisia (GR); Efstratios Christofidelis, Kifisia (GR)

(73) Assignee: BIC VIOLEX S.A., Anixi (GR)

( * ) Notice: Subject to any disclaimer, the term of this patent is extended or adjusted under 35 U.S.C. 154(b) by 0 days.

(21) Appl. No.: 14/762,234

(22) PCT Filed: Aug. 7, 2014

(86) PCT No.: PCT/EP2014/067038
§ 371 (c)(1),
(2) Date: Jul. 21, 2015

(87) PCT Pub. No.: WO2016/020009
PCT Pub. Date: Feb. 11, 2016

(65) Prior Publication Data
US 2016/0250766 A1 Sep. 1, 2016

(51) Int. Cl.
*B26B 21/52* (2006.01)
*B26B 21/14* (2006.01)

(52) U.S. Cl.
CPC ..... *B26B 21/522* (2013.01); *B26B 21/14* (2013.01); *B26B 21/528* (2013.01)

(58) Field of Classification Search
CPC ..... B26B 21/522; B26B 21/14; B26B 21/528
USPC ..... 30/50, 526–535; 16/430
See application file for complete search history.

(56) References Cited

U.S. PATENT DOCUMENTS

| | | | | |
|---|---|---|---|---|
| 2,189,689 A * | 2/1940 | Thompson | B26B 21/52 | 30/526 |
| 3,052,979 A | 9/1962 | Grassau | | |
| 4,028,803 A * | 6/1977 | Currie | A47G 21/02 | 16/430 |
| 5,031,319 A * | 7/1991 | Althaus | B26B 21/522 | 30/526 |
| 5,784,790 A * | 7/1998 | Carson, III | B26B 21/225 | 30/527 |
| 6,915,576 B2 * | 7/2005 | Brzezinski | B26B 21/46 | 30/123 |
| 7,874,076 B2 * | 1/2011 | Gratsias | B26B 21/522 | 16/430 |

(Continued)

FOREIGN PATENT DOCUMENTS

| | | |
|---|---|---|
| JP | 10-43444 | 2/1998 |
| WO | WO 97/37819 | 10/1997 |
| WO | WO 2006/081838 A1 | 8/2006 |

OTHER PUBLICATIONS

International Report of PCT/EP2014/067038; Oct. 13, 2014.

*Primary Examiner* — Sean Michalski
(74) *Attorney, Agent, or Firm* — Polsinelli PC

(57) ABSTRACT

A razor handle includes an elongated body extending in a longitudinal direction (C), the elongated body having an outer surface and being provided with a first hole opening on the outer surface, the razor handle further includes an element provided within the first hole, the element being integral with the elongated body and having a shape that is different from the shape of the first hole.

33 Claims, 9 Drawing Sheets

(56) References Cited

U.S. PATENT DOCUMENTS

| | | | | |
|---|---|---|---|---|
| D636,938 | S * | 4/2011 | White, Jr. | B26B 21/52 D28/48 |
| 7,975,389 | B2 * | 7/2011 | Bozikis | B26B 21/522 30/32 |
| 2004/0216311 | A1 | 11/2004 | Follo | |
| 2005/0198841 | A1 * | 9/2005 | Worrick, III | B26B 21/222 30/527 |
| 2008/0078086 | A1 * | 4/2008 | Wang | B26B 21/40 30/50 |
| 2009/0158600 | A1 * | 6/2009 | Ishai | B25G 1/00 30/314 |
| 2009/0255136 | A1 * | 10/2009 | Blackburn | B26B 21/225 30/526 |
| 2010/0064521 | A1 * | 3/2010 | DeLong | B26B 21/52 30/41 |
| 2014/0230255 | A1 * | 8/2014 | Stevens | B26B 21/40 30/526 |
| 2016/0136827 | A1 * | 5/2016 | Gulledge | B26B 21/521 30/526 |
| 2016/0250766 | A1 * | 9/2016 | Gratsias | B26B 21/522 |

* cited by examiner

RAZOR HANDLE COMPRISING AN ELEMENT WITHIN A HOLE AND RAZOR COMPRISING SUCH A RAZOR HANDLE

This application is a national stage application of International Application No. PCT/EP2014/067038, filed on Aug. 7, 2014, the entire contents of which are incorporated herein by reference.

The embodiments of the present invention relate to razor handles and razors.

BACKGROUND OF THE INVENTION

More precisely, the embodiments of the present invention relates to a razor handle that includes an elongated body extending in a longitudinal direction, the elongated body having an outer surface and being provided with a first hole opening on the outer surface, the razor handle further includes an element provided within the first hole.

EP 2250003 B1 discloses an example of a known razor handle that includes an inner core molded in a first rigid material and an insert member separate from the inner core. A second material forms a grip portion and encases the insert member.

However, it is often difficult to include such an insert member in a razor handle without increasing manufacturing time and costs. In addition, a risk exists that the insert member inadvertently detaches from the razor handle.

SUMMARY OF THE INVENTION

One objective of the present invention is to avoid these drawbacks. More specifically, one objective of the invention is to facilitate the manufacture of the razor handle according to the invention while improving the shaving experience of the user during shaving.

Another objective is to avoid any inadvertent separation of an element of the razor handle according to the invention.

This is solved by the fact that, according to the invention, the element is integral with the elongated body and has a shape that is different from the shape of the first hole.

The razor handle can thus be easily manufactured without needing to incorporate an insert which is non-unitary with the elongated body.

Besides, the element is in a material which is also a material of the elongated body.

The element can thus be easily moulded with the elongated body.

In advantageous embodiments of such razor handles, one and/or the other of the following features may be incorporated:

the elongated body includes a first material and a second material, the element being made of the second material;

the element is molded within the first hole;

the element includes a part which extends within the first hole in a direction perpendicular to the longitudinal direction;

the first material is chosen among the plastics whereas the second material is chosen among the rubbers;

the element has an outer surface which has the shape of a sphere;

the element forms a finger rest area;

the razor handle includes a second hole, the second hole opening on the outer surface of the elongated body;

the razor handle includes an insert partially encapsulated within the second hole;

the insert is immovable within the second hole, the immovable insert forming a finger rest area;

the insert is movable within the second hole;

the insert is a sphere;

the insert has a diameter which is comprised between 10 mm and 20 mm;

the insert has a diameter measured in a direction perpendicular to the longitudinal direction comprised between 10% and 80% of the width of the elongated body;

the insert is made in a rigid material having a density that is different from the density of the material of the elongated body;

the insert includes a material chosen among the metals, the plastics and the rubbers;

the elongated body has an upper face and a lower face, the lower face being opposite the upper face, the first and second holes being through-holes extending between the upper and lower faces;

the lower face is opposite the upper face, at least a part of the upper face and at least a part of the lower face being covered with the second material so that the parts respectively form at least an upper gripping area and at least a lower gripping area;

the element forms a unitary element with the second material covering the upper and lower faces;

the elongated body has two lateral sides opposite each other and extending in the longitudinal direction between the upper and lower faces, the lateral sides include a plurality of smooth ribs made of the second material, each of the smooth ribs connecting together the upper gripping area and the lower gripping area;

the razor handle extends between a front end and a rear end, the rear end being opposite the front end, the front end being provided with connecting means for connection to a shaving cartridge;

the insert is located in the vicinity of the front end, whereas the element is located in the vicinity of the rear end;

the insert is centered on a first point which is located at a distance measured along the longitudinal direction of about 30 mm from the front end;

the element is centered on a second point which is located at a distance measured along the longitudinal direction of about 20 mm from the rear end;

the distance between the first point and the second point measured along the longitudinal direction is comprised between 70 mm and 90 mm;

the insert is centered on a first point which is located at a distance comprised between 10% and 30% of the length of the razor handle measured along the longitudinal direction from the front end;

the element is centered on a second point which is located at a distance comprised between 10% and 30% of the length of the razor handle measured along the longitudinal direction from the rear end;

the distance between the first point and the second point measured along the longitudinal direction is comprised between 50% and 70% of the length of the razor handle;

each lateral side includes a plurality of spaced protruding pins in the vicinity of the front end of the razor handle;

the second hole has an interior lateral wall, a retaining ring protruding from the interior lateral wall and surrounding circumferentially, at least partially, the insert for maintaining the insert within the second hole;

the first hole is divided by an elongated bar extending in the longitudinal direction, the elongated bar includes a portion that surrounds circumferentially, at least partially, the element;

the second hole includes an interior lateral wall, the first hole further includes two projections opposite each other, protruding from the interior lateral wall, and having a shape which is partly complementary to the shape of the element;

each of the first and second holes delimits an interior space comprised inside the elongated body, the insert and the element having a size which is respectively inferior to the interior spaces of the first and second holes; and the razor handle has, in cross section, a general trapezoidal shape with smooth corners.

The invention also concerns a razor that includes such a razor handle and a shaving cartridge connected to the razor handle.

According to an embodiment, the shaving cartridge may comprise a trimming blade.

The above and other objects and advantages of the invention will become apparent from the detailed description of one embodiment of the invention, considered in conjunction with the accompanying drawings.

DETAILED DESCRIPTION OF THE EMBODIMENTS OF THE PRESENT INVENTION

In the various figures, the same references denote identical or similar elements.

Figure 1:
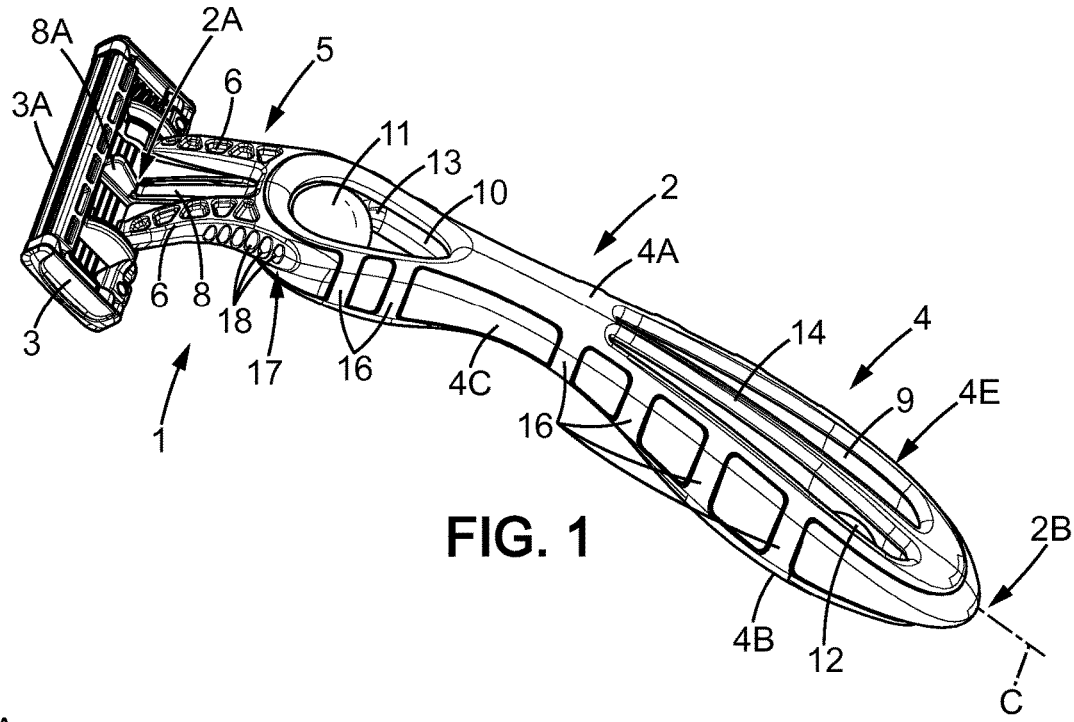
FIG. 1 is a perspective view of a razor according to the invention that includes a razor handle connected to a shaving cartridge.
Figure 2:
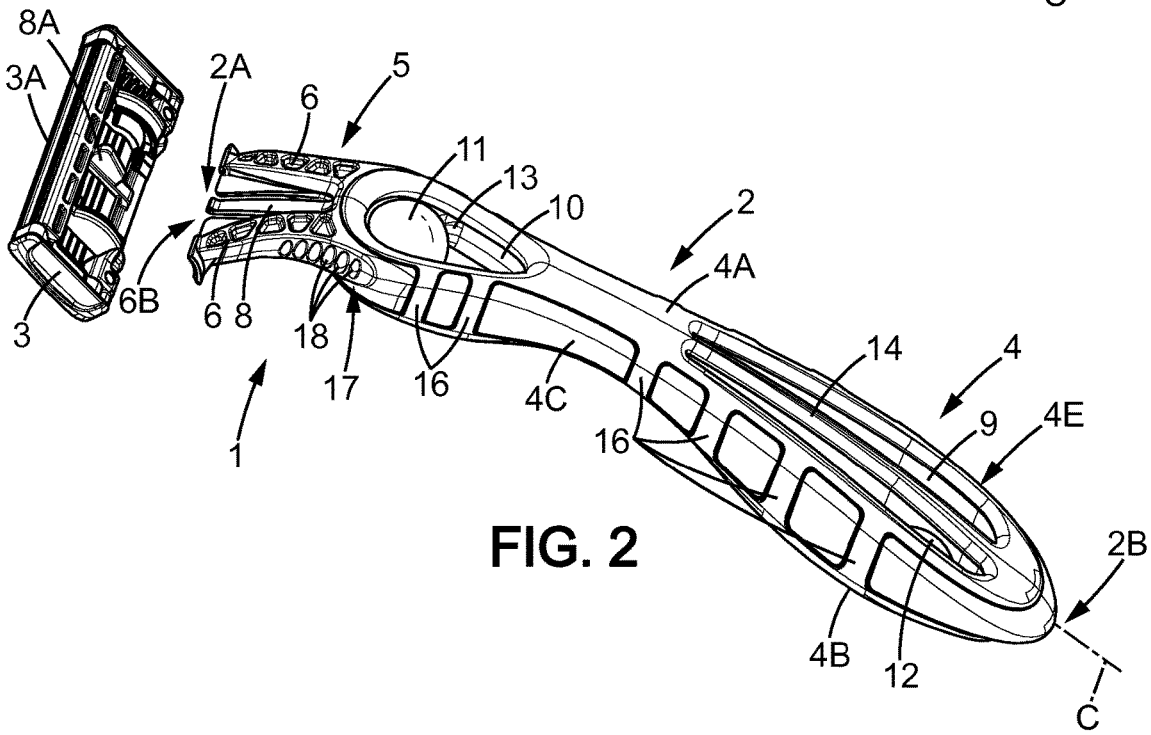
FIG. 2 is a perspective view of the razor of FIG. 1, the shaving cartridge being released from the razor handle.

FIG. 1 illustrates a wet shaving razor 1. The present invention includes a razor handle 2 and a shaving cartridge 3. The shaving cartridge 3 is preferably a disposable shaving cartridge that includes one or several blades 3A, which can be connected to or release from the razor handle 2 as shown respectively on FIGS. 1 and 2. The shaving cartridge 3 may also comprise at least one trimming blade, preferably on the side opposite to the blades 3A. The trimming blade edge is facing opposite with regard to the blade edge of blades 3A.

Figure 4:
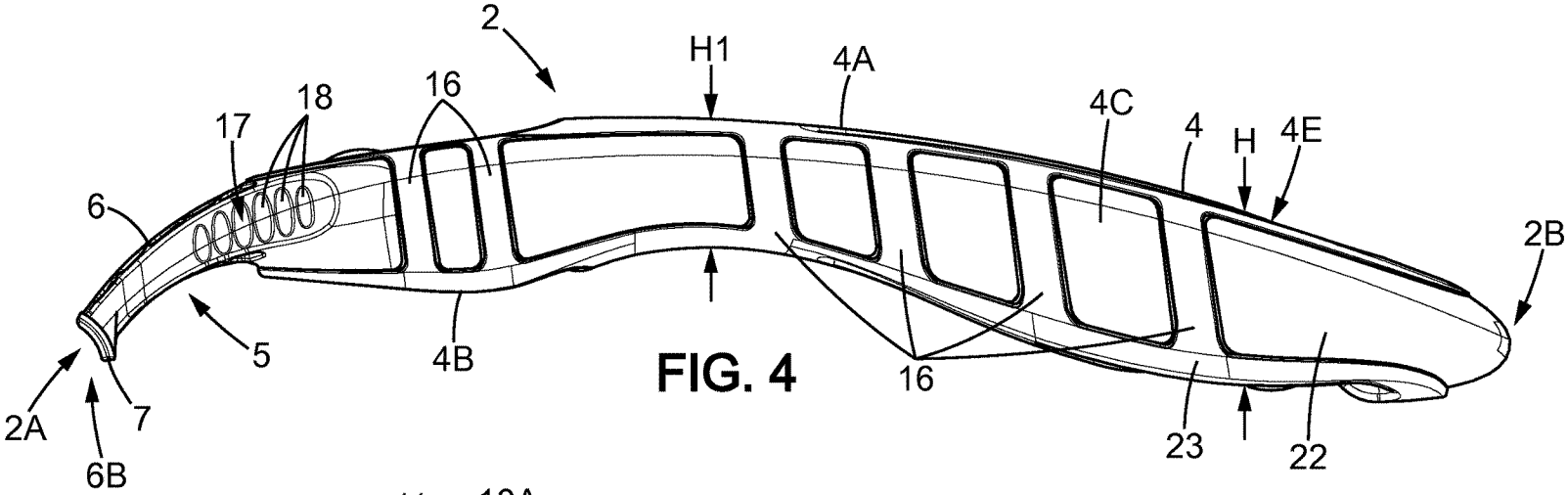
FIG. 4 is a side view of the razor handle of FIG. 1.

The razor handle 2 has a generally curved shape when viewed laterally as in FIG. 4. The razor handle 2 extends in a longitudinal direction C between a front end 2A and a rear end 2B, the rear end 2B being opposite the front end 2A. The razor handle 2 has also an elongated body 4 for hand grasping the razor handle 2. More precisely, the elongated body 4 extends longitudinally from the rear end 2B to a location near the front end 2A. The razor handle 2 further includes connecting means 5 in the continuation of the elongated body 4 up to the front end 2A. In other words, the elongated body 4 extends longitudinally from the rear end 2B to the beginning of the connecting means 5. The shaving razor 1 extends longitudinally from the rear end 2B to the free end of the connecting means 5 (the free end being the one to be connected to the shaving cartridge 3).

Figure 3A:
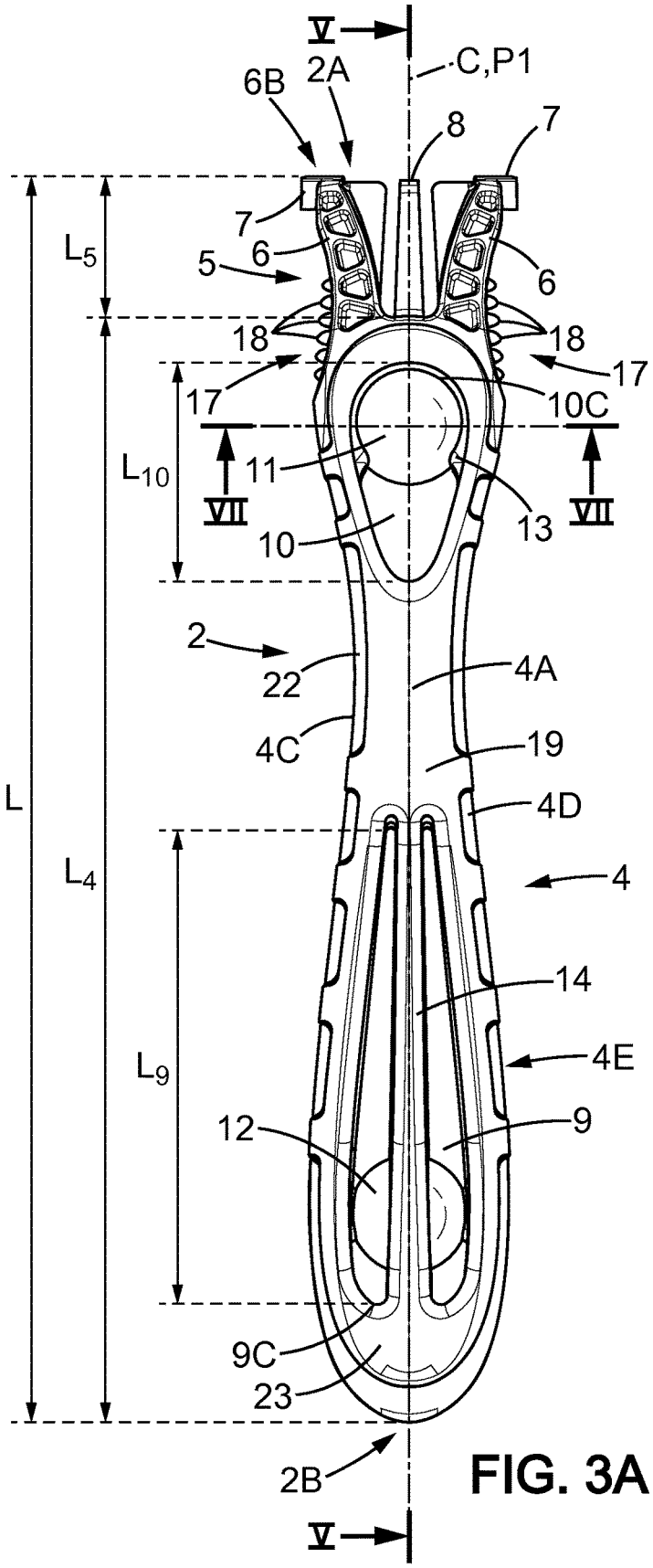
FIGS. 3A and 3B are respectively an upper and a lower view of the razor handle of FIG. 1.
Figure 3B:
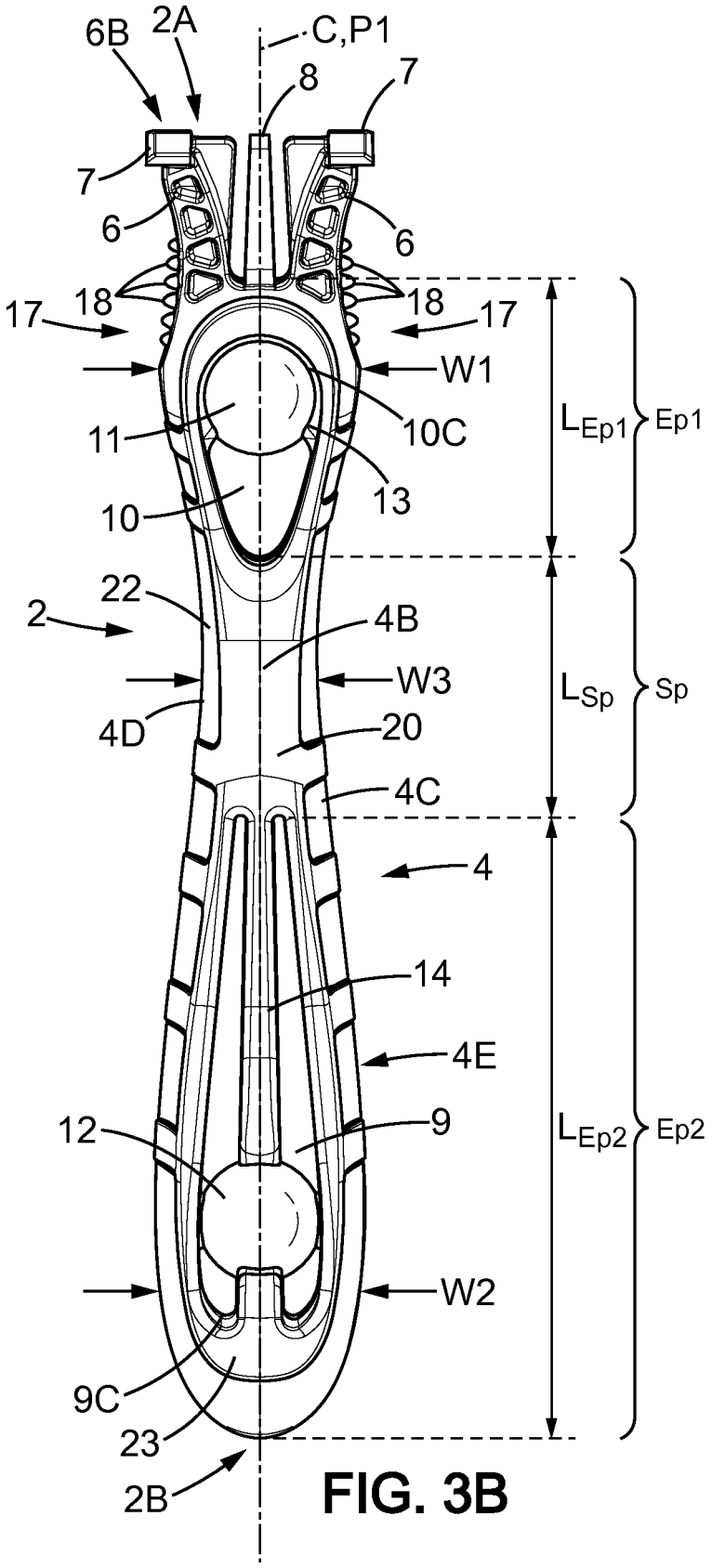

Referring to FIGS. 3A and 3B, it can be seen that the razor handle 2 can be symmetrical with respect of a median plane P1 and has a length L in the longitudinal direction C. The length L4 of the elongated body 4 measured along the longitudinal direction C can be comprised between 60% and 90% of the length L of the razor handle 2. The length L5 of the connecting means 5 measured along the longitudinal direction C can be comprised between 10% and 30% of the length L of the razor handle 2. The length L in the longitudinal direction C can be between 100 mm and 150 mm, preferably about 125 mm. The length L4 of the elongated body 4 is about 100 mm to about 120 mm, whereas the length L5 of the connecting means 5 is about 15 to 25 mm.

For instance, the length L of the razor handle 2 is of about 126 mm. The length L5 of the connecting means 5 is of about 17 mm. The length L4 of the elongated body 4 is of about 108 mm.

The razor handle 2 may also define a variable height H and a width W along the length L thereof. The height H of the razor handle 2 may vary along the direction C but is preferably comprised between 15 mm and 25 mm, preferably about 20 mm. As depicted in FIG. 4, the smallest height H1 of the elongated body 4 is located about the center of the razor handle 2.

It can be seen on the upper and lower views of the razor handle 2 of FIGS. 3A and 3B, that the razor handle 2 has also a first enlarged part Ep1 in the vicinity of the front end 2A, having a width W1 which is maximized. The elongated body also includes a second enlarged part Ep2 located in the vicinity of the rear end 2B of the razor handle 2 having a width W2 which is maximized. The first and second enlarged parts Ep1, Ep2 are connected together by a slim part Sp located about at the centre of the razor handle 2. In particular, the slim part Sp has a width W3 which is minimized. The first enlarged part Ep1 extends from this slim part Sp to the connecting means 5, whereas the second enlarged part Ep2 extends from the rear end 2B to this slim part Sp. The first and of the second enlarged part Ep1, Ep2 have a length LEp1, LEp2 along the longitudinal direction C which are respectively chosen such that the connection between the first and second enlarged parts Ep1, Ep2 with the slim part Sp have a smooth curvature.

The length LEp1 of the first enlarged part Ep1 measured along the longitudinal direction C can be comprised between 10% and 20% of the length L of the razor handle 2. The length Ep2 of the second enlarged part Ep2 measured along the longitudinal direction C can be comprised between 40% and 70% of the length L of the razor handle 2. The length LSp of the slim part Sp can be comprised between 10% and 20% of the length L of the razor handle 2. For instance, the length LEp1 of the first enlarged part Ep1 is of about 25 mm. The length LEp2 of the second enlarged part Ep2 is of about 55 mm. The length LSp of the slim part Sp is of about 25 mm.

Figure 11:
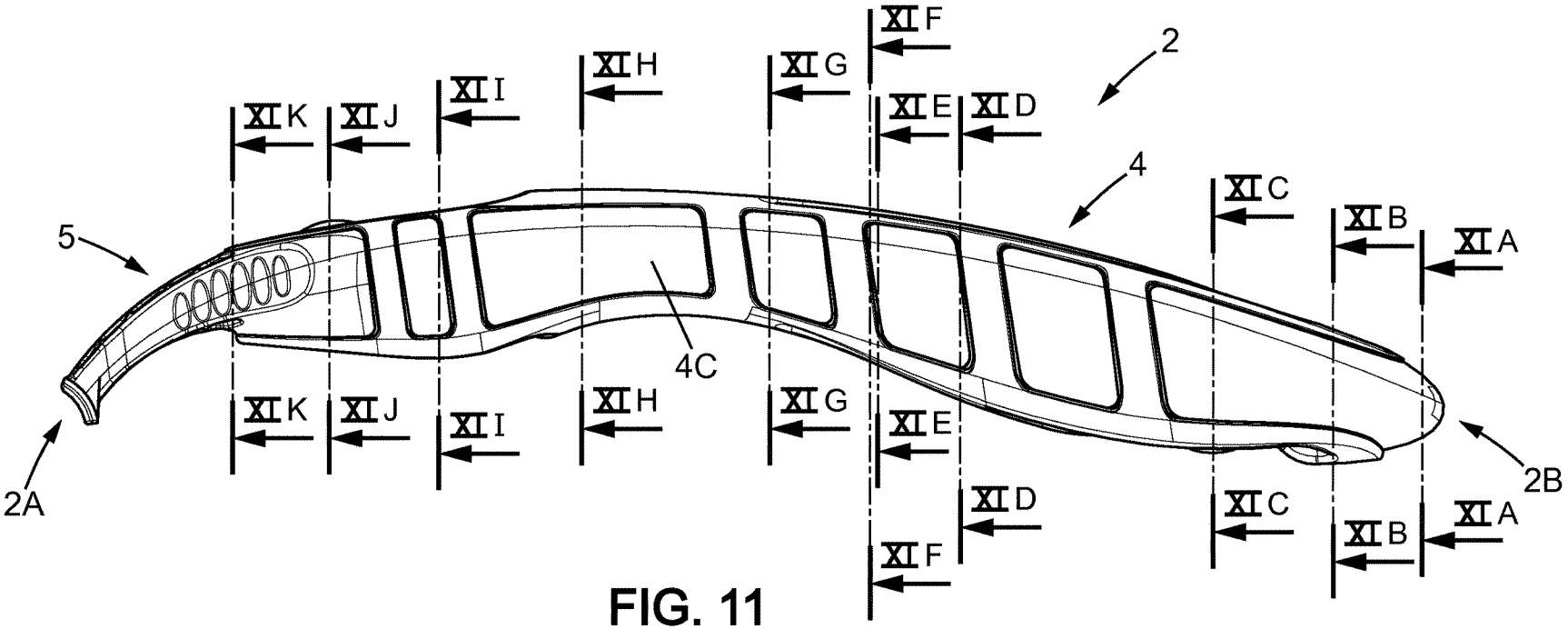
FIG. 11 is a side view of the razor handle of FIG. 1.
Figure 11A:
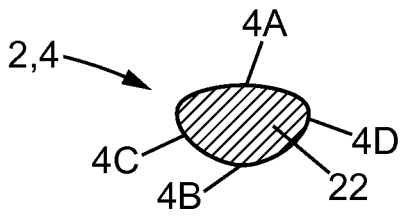
FIGS. 11A to 11K are cross sectional views of the razor handle of FIG. 11, taken respectively along the lines XIA-XIA to XIK-XIK.
Figure 11B:
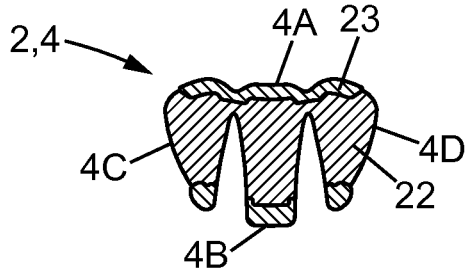
Figure 11C:
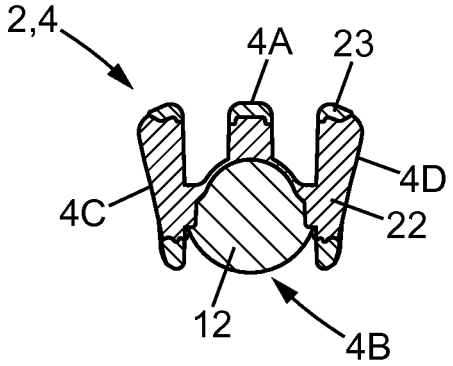
Figure 11D:
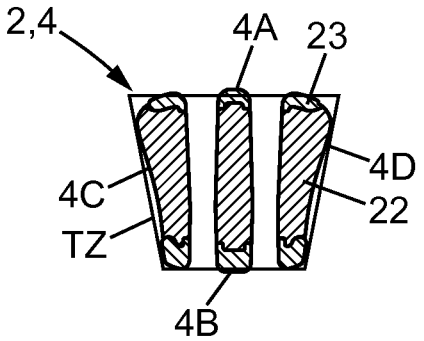
Figure 11E:
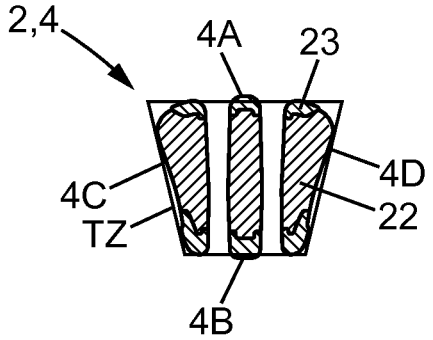
Figure 11F:
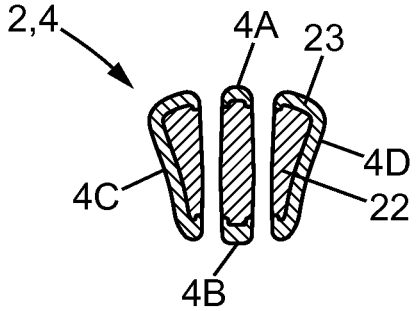
Figure 11G:
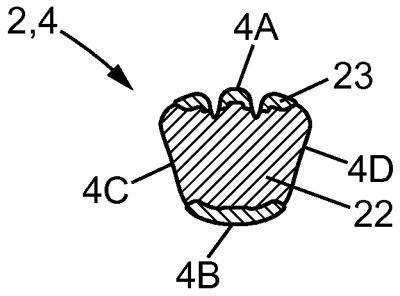
Figure 11H:
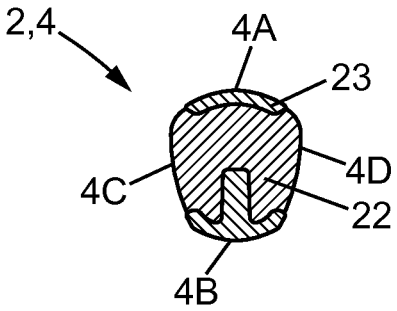

As depicted in FIGS. 11A to 11K, which are cross sections taken all along the razor handle 2 as depicted in FIG. 11, the razor handle 2 has, in cross section, a general trapezoidal shape with smooth corners, except in a zone located near the center of the razor handle 2. In this particular zone, the general shape of the razor handle 2 in cross section is more triangular, as depicted in FIG. 11H.

Figure 11I:
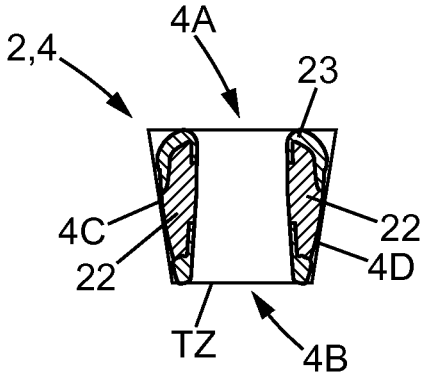

This general trapezoidal shape is highlighted on the figures by a virtual trapeze TZ put for instance on FIGS. 11D, 11E and 11I. A trapezoidal shape has four different faces for the fingers to rest on, whereas a triangular shape only has three different faces. Also, due to its general trapezoidal shape, the razor handle 2 thus has better and larger areas for finger gripping. This particular trapezoidal shape thus facilitates a comfortable grasping and shaving.

The connecting means 5 are integral with the elongated body 4 and includes two flexible arms 6 extending from the elongated body 4 and protruding toward a free end 6B at the front end 2A of the razor handle 2. In other words, the flexible arms 6 and the elongated body 4 are unitary.

Figure 10:
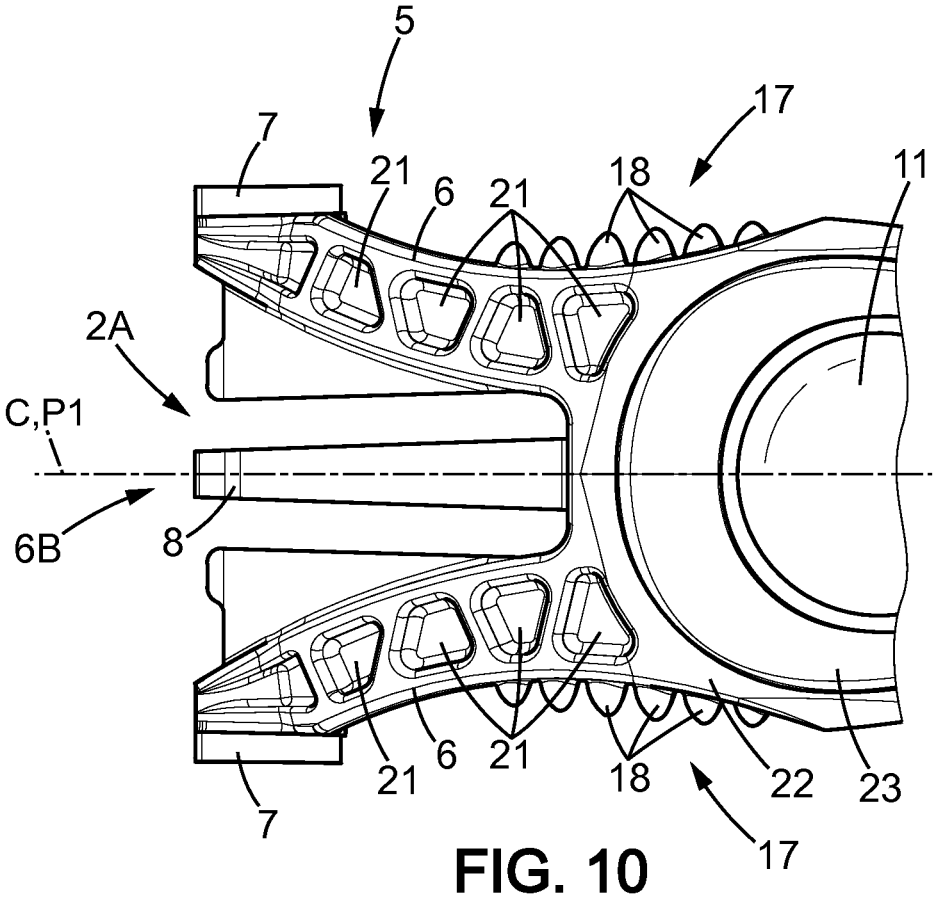
FIG. 10 is a partial upper view of the front end of the razor handle of FIG. 3A.

As depicted on FIG. 10, the two arms 6 may be disposed in a V shape, diverging from the longitudinal direction C of the razor handle 2 each provided, at the free end 6B, with a bearing structure 7 for connection to the shaving cartridge 3. In the disclosed embodiment, the shaving cartridge 3 is of the pivotal type, the bearing structures 7 allowing the pivoting of the shaving cartridge 3 when connected to the razor handle 2, whereas a longitudinal flexible tongue 8, extending between the arms 6 and cooperating with a groove 8A formed on the shaving cartridge 3, provides a spring force which biases the shaving cartridge 3 towards a rest position as illustrated in FIG. 1. However, the shaving cartridge 3 may also be fixed relatively to the razor handle 2.

Each arm 6 further has on its upper face a plurality of small cavities 21. Such a structure provides enough structural strength to the connecting means 5 for the purposes of human shaving, while saving weight and costs on this part of the razor handle 2. More precisely, the arms 6 and the flexible tongue 8 have a squared shape with smooth corners, allowing an improved robustness of the connecting means 5.

The elongated body 4 has an outer surface 4E, and more precisely an upper face 4A and a lower face 4B as depicted on FIGS. 3A and 3B, the lower face 4B being opposite the upper face 4A. The elongated body 4 further has two lateral sides 4C, 4D comprised between the upper and lower faces 4A, 4B, opposite each other and also extending in the longitudinal direction C. It can be seen in FIGS. 11A to 11I that the upper face 4A and the lower face 4B are convex, except for the lower face 4B in the vicinity of the front end 2A (i.e. where the connecting means 5 has a concave portion designed for facilitating hand grasping), and also except in the vicinity of the rear end 2B.

Figure 5:
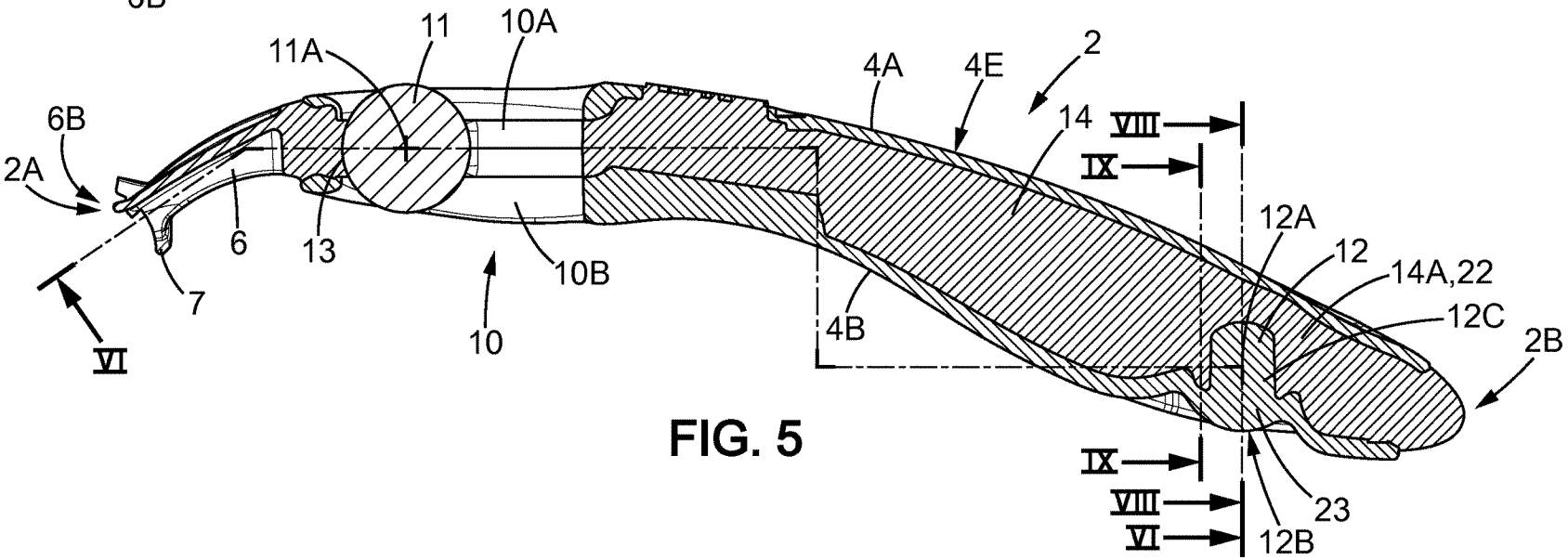
FIG. 5 is a longitudinal section of the razor handle shown in FIG. 3A along line V-V.
Figure 6:
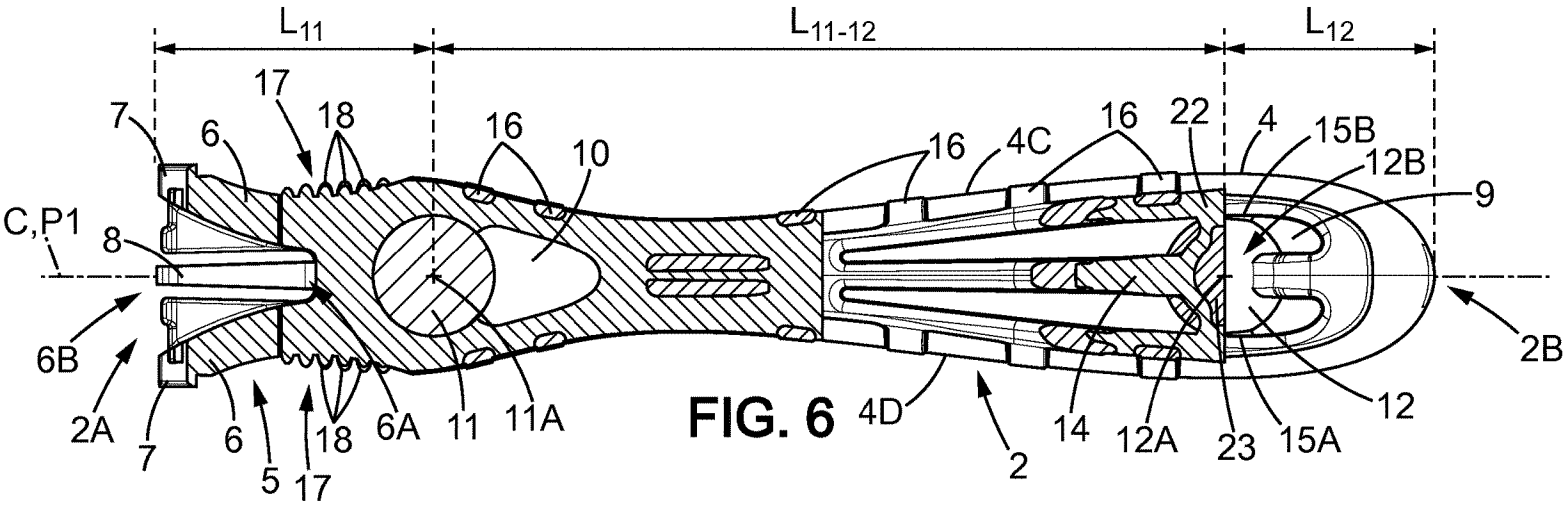
FIG. 6 is a section of the razor handle shown in FIG. 5 along line VI-VI.

As seen for instance on FIG. 5 which is a longitudinal section of the razor handle 2, the elongated body 4 and the connecting means 5 form a unitary element moulded out of a first material 22. The first material 22 may be any moldable material. Preferably, the first material 22 is rigid. For instance, the first material 22 is chosen among the plastics and the rubbers. Also, the elongated body 4 and the connecting means 5 can be moulded in a thermoplastic material, for instance in acrylonitrile butadiene styrene (ABS) or in polypropylene (PP The elongated body 4 may thus comprise only one material. In another embodiment, the elongated body 4 may also comprise a second material 23 different from the first material 22. The second material may be chosen among the rubbers. The second material 23 may be an elastomeric material, such as thermoplastic elastomers (TPE). For instance, the second material 23 may be elastic and deformable by a user.

The second material 23 may also be chosen among the plastics. More precisely, the second material 23 may be rigid plastics. Using plastics for the second material 23 permits to have lower cost of production and a simpler manufacturing process of the razor handle 2. Besides, the second material 23 may have a color that is different from the color of the first material 22, thus showing a contrast between the first material 22 and the second material 23. According to another embodiment, the second material 23 may be transparent to give a glaze look to the razor handle 2.

The second material 23 provides the softness required for comfortable hand grasping and firm finger gripping in any shaving position. As depicted in FIGS. 3A and 3B, at least a part 19 of the upper face 4A and at least a part 20 of the lower face 4B can be covered with the second material 23 so that the parts 19, 20 respectively form an upper gripping area and a lower gripping area. More preferably, as can be seen, for example, on FIGS. 11A-11K, the second material 23 covers the majority, preferably all, of the upper face 4A of the elongated body 4. The second material 23 also covers the majority, preferably all, of the lower face 4B of the elongated body 4.

The elongated body 4 further includes a first hole 9. The first hole 9 is preferably located in the second enlarged part Ep2 of the razor handle 2. The elongated body 4 may further include a second hole 10. The second hole 10 is preferably located in the first enlarged part Ep1 of the razor handle 2.

The first and second holes 9, 10 are preferably through-holes that extend between the upper face 4A and the lower face 4B of the elongate body 4. Alternatively, the first and second holes 9, 10 may also be through-holes that extend between the lateral sides 4C, 4D. Besides, the first and second holes 9, 10 may be blind holes that open on the outer surface 4E of the elongated body 4, and in particular on the upper face 4A or on the lower face 4B.

Figure 9:
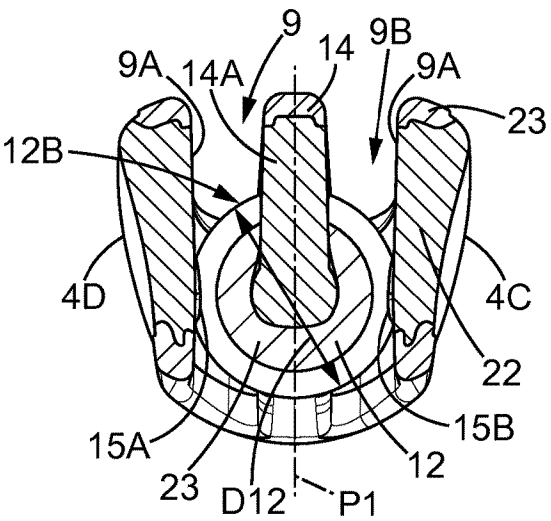
FIG. 9 is a section of the razor handle shown in FIG. 5 along line IX-IX.
Figure 8:
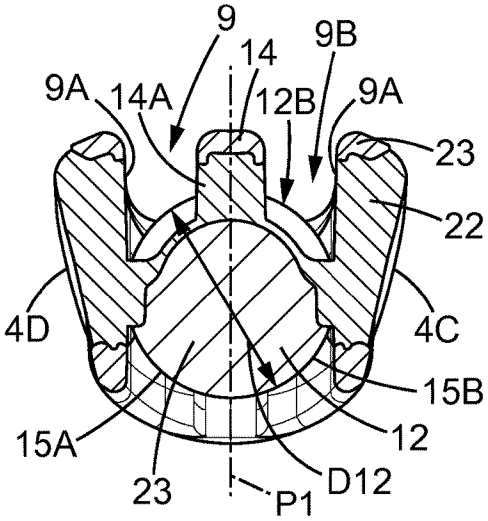
FIG. 8 is a section of the razor handle shown in FIG. 5 along line VIII-VIII.
Figure 7:
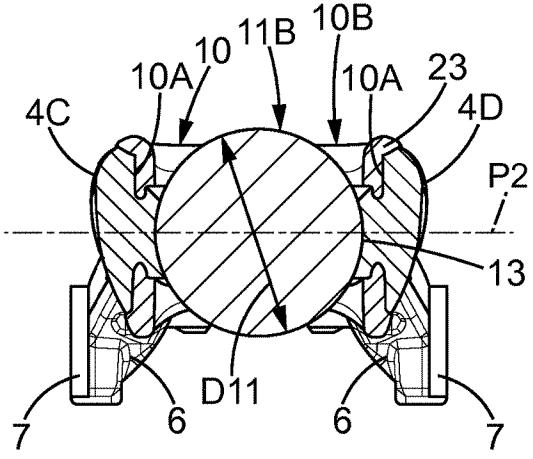
FIG. 7 is a section of the razor handle shown in FIG. 3A along line VII-VII.
Figure 11J:
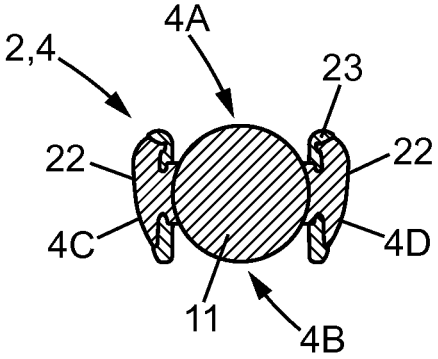
Figure 11K:
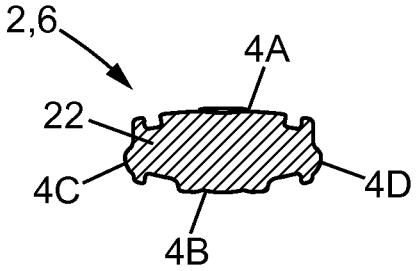

As shown in FIGS. 7, 8 and 9, each of the first and second holes 9, 10 has respectively an interior side wall 9A, 10A, each of which delimiting an interior space 9B, 10B comprised inside the elongated body 4 between the upper and the lower faces 4A, 4B. More particularly, the interior side walls 9A, 10A of each of the first and second holes 9, 10 comprise a semi-circular portion 9C, 10C. The first and second holes 9, 10 converge in a V-shape from these semi-circular portions 9C, 10C in the longitudinal direction C towards the slim part Sp in the centre of the razor handle 2. Also, both of the first and second holes 9, 10 preferably have drop-shapes respectively oriented in opposite direction when seen from an upper or a lower view as illustrated in FIGS. 3A and 3B. In other words, viewed from the top or lower side, the first and second holes 9, 10 which are connected via the slim part Sp, have a general shape forming a kind of eight. As depicted in FIGS. 7 and 11J, the second material 23 may overflow, at least partially, on the interior side wall 10B of the second hole 10.

The first hole 9 has a length L9 that may be comprised between 10% and 40% of the length L of the razor handle 2 in the longitudinal direction C. For instance, the length L9 of the first hole 9 along the longitudinal direction is comprised between 40 mm and 60 mm, preferably about 47 mm. The second hole 10 has a length L10 that may be comprised between 10% and 30% of the length L of the razor handle 2 in the longitudinal direction C. For instance, the length L10 of the second hole 10 along the longitudinal direction is comprised between 10 mm and 30 mm, preferably about 22 mm. Also, as illustrated in FIG. 3B, the first enlarged part Ep1 extends from the connecting means 5 to the end of the second hole 10 located towards the centre of the razor handle 2. The slim part Sp extends from this end of the second hole 10 located towards the centre of the razor handle 2 to the end of the first hole 9 also located towards the centre of the razor handle 2. The second enlarged part Ep2 extends from the end of the first hole 9 located towards the centre of the razor handle 2 to the rear end 2B.

The razor handle 2 further includes an element 12 located respectively within the first hole 9. The element 12 is preferably molded within the interior space 9B of the first hole 9. In particular, the element 12 may have a shape that is different from the shape of the first hole 9. Advantageously, the element 12 has a size which is inferior to the size of the first hole 9. According to this particular embodiment, the element 12 does not fill all the interior space 9B of the first hole 9, and some space of the first hole 9 remains free from the element 12. Also, as illustrated on FIGS. 3A and 3B, the length L9 of the first hole 9 in the longitudinal direction C is greater than the longitudinal size of the element 12.

As depicted on FIG. 5, the element 12 has a part 12C which extends within the first hole 9 in a direction which is perpendicular to the longitudinal direction C. This part 12C thus permits to anchor the element 12 within the razor handle 2, and in particular to the first material 22 of the elongated body 4. The element 12 also includes an outer surface 12B which is visible to the user. More preferably, the outer surface 12B of the element 12 is touchable by a user while shaving. The outer surface 12B of the element 12 may have a spherical shape. More precisely, the outer surface 12B may have the shape of a sphere at least on the upper face 4A and/or on the lower face 4B of the elongated body 4 as depicted on FIG. 3B. The outer surface 12B may have an ovoid shape. More generally, the outer surface 12B of the element 12 may have any other shape such as a parallelipipedic, cubical or cylindrical shape. In the embodiment described on the figures, the outer surface 12B of the element 12 has preferably the shape of a sphere on the upper and lower faces 4A, 4B of the elongated body 4.

The element 12 may be integral with the elongated body 4. By integral with, it has to be understood that the element 12 is made of a material of the elongated body 4.

According to an embodiment, the element 12 may be made of the first material 22. For instance, the element 12 may be molded together with the elongated body 4 from the first material 22, thereby allowing reducing manufacturing cost.

The element 12 may also be made of the second material 23. As depicted on FIG. 5, the element 12 is integral with the second material 23 which covers the upper face 4A and/or the lower face 4B of the elongated body 4. In other words, the element 12 and the layer of second material 23 covering the upper face 4A and/or the lower face 4B are unitary so that no discontinuity of material exists between the element 12 and the second material 23 of the elongated body 4.

As illustrated in FIG. 8, the first hole 9 is divided in two parts by an elongated bar 14 extending in the longitudinal direction C and within the first hole 9 in the plane P1. The elongated bar 14 includes a portion 14A made of the first material 22 that surrounds circumferentially partially the element 12. The interior side wall 9A of the first hole 9 also includes two small projections 15A, 15B opposite each other, preferably made of the first material 22. The projections 15A, 15B protrude from the interior side wall 9A and have a shape which is partly complementary to the shape of the element 12.

The element 12 may be located in the vicinity of the rear end 2B. Preferably, the element 12 is centered on a second point 12A which is located at a distance L12 comprised between 10% and 30% of the length L of the razor handle 2 measured along the longitudinal direction C from the rear end 2B. For instance, the distance L12 may be of about 21 mm from the rear end 2B.

The razor handle 2 may also comprise an insert 11 located within the interior space 10B of the second hole 10. The insert 11 may be partially encapsulated within the second hole 10 as illustrated in FIG. 5. Preferably, less than 75%, and preferably less than 50% of the surface of the insert 11 is encapsulated within the second hole 10. In other words, the surface of the insert 11 which is encapsulated cannot be directly touchable by the user as it is surrounded with the first material 22 of the elongated body 4. Besides, the insert 11 has also an outer surface 11B which is not encapsulated.

The insert 11 may have a spherical shape. The insert 11 may have an ovoid shape. More generally, the insert 11 may have any other shape such as a parallelipipedic, cubical or cylindrical shape. In particular, the insert 11 may have a shape that is different from the shape of the second hole 10. Advantageously, the insert 11 has a size which is inferior to the size of the second hole 10. Also, as illustrated on FIGS. 3A and 3B, the length L10 of the second hole 10 in the longitudinal direction C is greater than the longitudinal size of the insert 11.

The insert 11 is preferably made in a material chosen among the metals, the plastics and the rubbers. In particular, the insert 11 is preferably made in a rigid material having a density that is significantly different from the density of the first material 22 and of the second material 23 of the elongated body 4. The insert 11 thus contribute to raise weight of the razor handle 2 without significantly increasing the volume of the razor handle 2. As a consequence, the razor handle 2 can be heavy enough to provide a good shaving and to make sure that a good contact is provided between the blades 3A of the shaving cartridge 3 and the skin of the user to be shaved. In the embodiment in which the shaving cartridge 3 includes a trimming blade, the razor handle 2 may be reversed of 90 degrees to use this trimming blade. In trimming position, the insert 11 retains the same purpose as during shaving. The insert 11 still provides a defined surface that helps control the contact between the trimming blade and the hair to be trimmed. Besides, the insert 11 can still be used as a grip surface by the user by positioning his fingers preferably on the surface of the insert 11 which is not encapsulated on the lower face 4B of the elongated body 4. The user is therefore not forced to adjust finger placement and can use the razor handle 2 in the same manner as for shaving.

Besides, due to the insert 11, the elongated body 4 can therefore be in a material which is lighter and cheaper when compared to the material used in known razor handles. Nevertheless, despite the lightness of the first and second materials 22, 23, the razor handle 2 still has a good quality appearance and an optimized weight thanks to the insert 11. Since the material of the insert 11 can be different from the first and second material 22, 23 of the elongated body 4, the user can easily determine through touch whether his fingers are well placed on the insert 11 of the razor handle 2. By determining the location of the insert 11, the user can also be guided to place his fingers on the free space of the second hole 10 that may serve as finger rest areas. Preferably, the insert 11 is only made of metal and does not comprise any other material.

The insert 11 can also be made with several materials. In particular, the insert 11 can be covered with a layer of another material having a smooth surface. As an example, the insert 11 may be made of metal and covered by a layer of rubber. In this embodiment, the layer can have a surface finish comprised between 0.5 μm and 1.6 μm (roughness Ra). As another alternative, the insert 11 may be a sphere of which one hemisphere is made of rubber and the other hemisphere is made of plastic. The insert 11 may thus serve a double purpose by providing different types of finger rest areas.

The insert 11 is preferably maintained, advantageously secured, within the second hole 10 and can therefore not be detached from the second hole 10 by a user. Besides, the insert 11 cannot move in any manner in the second hole 10. As a consequence, the insert 11 is not movable (i.e. immovable or motionless) respectively relative to the second hole 10. The non-movable insert 11 thus forms a finger rest area. More precisely, the insert 11 cannot slide in the second hole 10. More particularly, as depicted in FIG. 7, a retaining ring 13, preferably made of the first material 22, protrudes from the interior side wall 10A of the second hole 10 in a plane P2 perpendicular to the symmetry plane P1 of razor handle 2 and surrounds circumferentially partially the insert 11 for maintaining the insert 11 within the second hole 10.

However, in another embodiment, the insert 11 may be a sphere that can rotate on itself about its own axis in all directions. Also, a gap may be provided between the insert 11 and the retaining ring 13 in order to facilitate the rotation of the insert 11 when it is a sphere. The gap may be comprised between 0.005 μm and 0.025 μm depending on the chosen rotational freedom of the insert 11. A smaller gap prevents the insert 11 from rotating easily whereas a bigger gap facilitates the rotation. The surface finish of the insert 11 is adapted to allow this movability, especially the rotation. In the case where the insert 11 includes two hemispheres made of different materials and thus having different density, the user can switch between the two hemispheres as needed by rotating the insert 11. A user that may position one of his fingers on such a movable insert 11 will find difficult to shave as his finger(s) will constantly slip on the insert 11. Shaving will therefore be imprecise and uncomfortable. As a consequence, when the insert 11 is movable relative to the second hole 10, it cannot form a finger rest area.

The insert 11 is located in the vicinity of the front end 2A. Preferably, the insert 11 is centered on a first point 11A which is located at a distance L11 comprised between 10% and 30% of the length L of the razor handle 2 measured along the longitudinal direction C from the front end 2A. For instance, the distance L11 may be of about 25 mm from the front end 2A.

The surface 12B of the element 12 and/or the surface 11B of the insert 11 can be directly or indirectly, as detailed hereafter, touchable with a finger of a user. Also, the outer surface 12B of the element 12 and/or the surface 11B of the insert 11 can form finger rest areas on the upper face 4A and/or on the lower face 4B of the elongated body 4. In this manner, when a user wants to shave, he may position his fingers on the location of the element 12 and/or of the insert 11, and preferably on the surfaces 12B of the element 12 and/or on the outer surface 11B of the insert 11 which are not encapsulated.

Preferably, the element 12 and the insert 11 enhance hand grasping in certain shaving positions, such as in a position where the razor handle 2 is held between the index and the thumb, the thumb resting on the insert 11 on the upper face 4A whereas the index rests on the insert 11 on the lower face 4B of the razor handle 2. In another shaving position, the thumb and the index of the user can also rest on the element 12. However, the element 12 may not be directly touchable with a finger of a user on the upper face 4A as the elongated bar 14 may cover partially the element 12. According to this alternative, the element 12 is covered at least partially with the first material 22 of the elongated bar 14. The user may position his finger(s) on the elongated bar 14 on the upper face 4A of the elongated body 4 when shaving.

The material chosen for the insert 11 and/or for the element 12 may also have an impact on the sensing experience of the user when he positions his fingers on the insert 11 and on the element 12. As an example, an insert 11 made of metal provides a pin-point contact with the fingers of the user, thus allowing the communication of all transmitted vibrations from shaving. To the contrary, an element 12 made of the second material 23 chosen for instance among the rubbers, such as thermoplastics, absorbs most of the vibrations from shaving and does not transmit them to the fingers of the user.

The insert 11 provided within the second hole 10 may be made of metal whereas the element 12 provided within the first hole 9 may be made of rubber. According to this alternative, the insert 11, which is thus in metal, reinforces the comfort feeling and handle control when a user places his/her index finger on it. It also enhances the directional tactile feedback of the user due to the difference of texture, temperature and shape that exist between the insert 11 in metal and the second material 23 of the element 12.

The insert 11 and the element 12 may also have an irregular surface, for instance with craters or bumps due to a knurled pattern or a divot pattern. As a matter of fact, the type of surface of the insert 11 and of the element 12 affect the tactile sensing of the user when he positions his fingers on the insert 11 and/or on the element 12.

The insert 11 and the element 12 may have similar shapes or different ones. The insert 11 and the element 12 may have the same dimensions or may have different ones. As depicted on the FIGS. 1-3 and 5-9, each of the insert 11 and of the element 12 has outer surfaces 11B, 12B in the shape of a sphere. Such outer surfaces of the insert 11 and of the element 12 have preferably a respective diameter D11, D12 measured in a direction perpendicular to the longitudinal direction C which is comprised between 10% and 80% of the width W1 of the elongated body 4. For instance, the diameters D11, D12 are comprised between 10 mm and 20 mm, preferably inferior to 15 mm, and more preferably of about 12 mm. However, the element 12 may have a diameter D12 that is different from the diameter D11 of the insert 11. The outer surface 12B of the element 12, which has the shape of a sphere, enriches the softness when placing the fingers on the razor handle 2. It also enhances the visual continuity with the insert 11 in this particular alternative in which the insert 11 is also a sphere. However, according to this alternative, each of the insert 11 and of the element 12 may not be complete spheres and may only comprise a partial curved surface, especially a partial spherical surface which serves as a finger rest area.

As illustrated on FIG. 5, in the particular embodiment in which the insert 11 and the element 12 have the shape of a sphere, the first point 11A and the second point 12A respectively correspond to the centre of the insert 11 and the element 12. The distance L11-12 between the first point 11A and the second point 12A measured along the longitudinal direction (C) is preferably comprised between 50% and 70% of the length L of the razor handle 2. The distance L11-12 may be comprised between 60 mm and 100 mm, preferably of about 78 mm. However, this distance L11-12 may vary depending on the length L4 of the elongated body 4 as well as on the weight balance to be preferred due to the insert 11 and to the element 12.

Known razors without any element or insert usually have a center of balance that is located in the center of the razor handle, or slightly towards the front end toward the razor handle. To this end, the rear part of the razor handle cannot be much larger than its front part, and vice versa, in order to achieve this center of balance. In the present invention, by adding an insert 11 at a precise location from the front end 2A of the razor handle 2, it is possible to control the location of this center of balance regardless the shape of the razor handle 2. For instance, the center of balance may be positioned at the center of the razor handle 2 in the longitudinal direction C even though the second enlarged part Ep2 is significantly larger than the first enlarged part Ep1. Preferably, the inclusion of the insert 11 and of the element 12 does not lead to an excessive deformation of the shape of the elongated body 4. The shape of the elongated 4 preferably remains similar to the shape of an elongated body that would not include any insert or any element.

The lateral sides 4C, 4D of the elongated body 4 further includes a plurality of smooth ribs 16 made of the second material 23. As shown in FIG. 4, each lateral side 4C, 4D of the elongated body 4 includes preferably a plurality of ribs 16 connecting together the upper and lower gripping areas 19, 20. In the particular embodiment shown in FIG. 4, each of the lateral sides 4C, 4D of the first enlarged part Ep1 includes two ribs 16 and the lateral sides 4C, 4D of the second enlarged part Ep2 includes four ribs 16.

As depicted on FIGS. 1-4 and 10, each lateral side 4C, 4D may also comprise a side gripping area 17 includes a plurality of spaced protruding pins 18 integral with the connecting means 5 and located in the vicinity of the front end 2A of the razor handle 2 at the junction of the connecting means 5 with the elongated body 4. The side gripping areas 17 enhance finger gripping of the razor handle 2, especially in a shaving position where the thumb and the index finger are positioned very close to the front end 2A, and preferably to the arms 6 for satisfying the need of precise shaving.

According to an embodiment, it is possible to exchange the positions of the element 12 and of the insert 11. More precisely, the element 12 may be located in the vicinity of the front end 2A and the insert 11 may be located in the vicinity of the rear end 2B. According to this embodiment, the first hole 9 is more particularly located in the vicinity of the front end 2A and the second hole 10 is located in the vicinity of the rear end 2B. Also, the insert 11 is thus centered on a first point 11A which is located at a distance L11 comprised between 10% and 30% of the length L of the razor handle 2 measured along the longitudinal direction C from the rear end 2B. For instance, the distance L11 may be of about 21 mm from the rear end 2B. The element 12 is centered on a second point 12A which is located at a distance L12 comprised between 10% and 30% of the length L of the razor handle 2 measured along the longitudinal direction C from the front end 2A. For instance, the distance L12 may be of about 25 mm from the front end 2A.

Besides, the razor handle 2 may not comprise an insert 11 but may instead comprise a second element identical to the element 12 located respectively within the interior space 10B of the second hole 10. According to this embodiment, the second element may be made of the first material 22 or of the second material 23.

The razor handle 2 may have more than one insert and more than one fixed elements. For instance, the razor handle 2 may comprise a third hole in which is located another insert or another element. Besides, several elements and/or inserts may be located within the same hole. For instance, several inserts having small diameters, for instance a trinity of inserts, can be located within the second hole 10. Similarly, several small elements, for instance a trinity of elements, may be located within the first hole 9.

The invention claimed is:

1. A razor handle comprising an elongated body extending in a longitudinal direction, the elongated body having an outer surface and being provided with a first hole opening on the outer surface, the razor handle further comprising an element provided within the first hole, wherein the element is integral with the elongated body and has a shape that is different from a shape of the first hole, and wherein the element has an outer surface which has the shape of a sphere.

2. The razor handle according to claim 1, wherein the elongated body comprises a first material and a second material, the element being made of the second material.

3. The razor handle according to claim 2, wherein the first material is chosen among the plastics whereas the second material is chosen among the rubbers.

4. The razor handle according to claim 1, wherein the element is molded within the first hole.

5. The razor handle according to claim 1, wherein the element comprises a part which extends within the first hole in a direction perpendicular to the longitudinal direction.

6. The razor handle according to claim 1, wherein the element forms a finger rest area.

7. The razor handle according to claim 1, wherein the razor handle comprises a second hole, the second hole opening on the outer surface of the elongated body.

8. The razor handle according to claim 7, wherein the razor handle comprises an insert partially encapsulated within the second hole.

9. The razor handle according to claim 8, wherein the insert is immovable within the second hole, the immovable insert forming a finger rest area.

10. The razor handle according to claim 8, wherein the insert is movable within the second hole.

11. The razor handle according to claim 8, wherein the insert is a sphere.

12. The razor handle according to claim 11, wherein the insert has a diameter measured in a direction perpendicular to the longitudinal direction comprised between 10% and 80% of the width of the elongated body.

13. The razor handle according to claim 8, wherein the insert is made in a rigid material having a density that is different from the density of the material of the elongated body.

14. The razor handle according to claim 8, wherein the insert comprises a material chosen among metals, plastics and rubbers.

15. The razor handle according to claim 7, wherein the elongated body has an upper face and a lower face, the lower face being opposite the upper face, the first and second holes being through holes extending between the upper and lower faces.

16. The razor handle according to claim 15, wherein the lower face being opposite the upper face, at least a part of the upper face and at least a part of the lower face being covered with the second material so that the parts respectively form at least an upper gripping area and at least a lower gripping area.

17. The razor handle according to claim 16, wherein the element forms a unitary element with the second material covering the upper and lower faces.

18. The razor handle according to claim 16, wherein the elongated body has two lateral sides opposite each other and extending in the longitudinal direction between the upper and lower faces, the lateral sides comprising a plurality of smooth ribs made of the second material, each of the smooth ribs connecting together the upper gripping area and the lower gripping area.

19. The razor handle according to claim 1, wherein the razor handle extends between a front end and a rear end, the rear end being opposite the front end, the front end being provided with connecting means for connection to a shaving cartridge.

20. The razor handle according to claim 8, wherein the razor handle extends between a front end and a rear end, the rear end being opposite the front end, the front end being provided with connecting means for connection to a shaving cartridge, and wherein the insert is located in the vicinity of the front end, whereas the element is located in the vicinity of the rear end.

21. The razor handle according to claim 20, wherein the insert is centered on a first point which is located at a distance comprised between 10% and 30% of the length of the razor handle measured along the longitudinal direction from the front end.

22. The razor handle according to claim 20, wherein the element is centered on a second point which is located at a distance comprised between 10% and 30% of the length of the razor handle measured along the longitudinal direction from the rear end.

23. The razor handle according to claim 22, wherein the distance between the first point and the second point measured along the longitudinal direction is comprised between 50% and 70% of the length of the razor handle.

24. The razor handle according to claim 19, wherein each lateral side comprises a plurality of spaced protruding pins in the vicinity of the front end of the razor handle.

25. The razor handle according to claim 8, wherein the second hole has an interior lateral wall, a retaining ring protruding from the interior lateral wall and surrounding circumferentially, at least partially, the insert for maintaining the insert within the second hole.

26. The razor handle according to claim 1, wherein the first hole is divided by an elongated bar extending in the longitudinal direction, the elongated bar comprising a portion that surrounds circumferentially, at least partially, the element.

27. The razor handle according to claim 1, wherein the first hole comprises an interior lateral wall, the first hole further comprising two projections opposite each other, protruding from the interior lateral wall, and having a shape which is partly complementary to the shape of the element.

28. The razor handle according to claim 8, wherein each of the first and second holes delimits an interior space comprised inside the elongated body, the element and the insert having a size which is smaller than a size of the interior spaces of the first and second holes.

29. The razor handle according to claim 1, wherein the razor handle has, in cross section, a trapezoidal shape.

30. A razor comprising a razor handle according to claim 1 and a shaving cartridge connected to the razor handle.

31. The razor according to claim 20, wherein the shaving cartridge comprises a trimming blade.

32. A razor handle comprising an elongated body extending in a longitudinal direction, the elongated body having an outer surface and being provided with a first hole opening on the outer surface, the razor handle further comprising an element provided within the first hole, wherein the element is integral with the elongated body and has a shape that is different from the shape of the first hole, wherein the razor handle comprises a second hole opening on the outer surface of the elongated body, wherein the razor handle comprises an insert partially encapsulated within the second hole, and wherein the insert is a sphere.

33. A razor handle comprising an elongated body extending in a longitudinal direction, the elongated body having an outer surface and being provided with a first hole opening on the outer surface, the razor handle further comprising an element provided within the first hole, wherein the element is integral with the elongated body and has a shape that is different from the shape of the first hole, wherein the razor handle comprises a second hole opening on the outer surface of the elongated body, wherein the razor handle comprises an insert partially encapsulated within the second hole and wherein the second hole has an interior lateral wall, a retaining ring protruding from the interior lateral wall and at least partially surrounding circumferentially the insert, wherein the retaining ring maintains the insert in the second hole.

* * * * *